US005836331A

United States Patent [19]

Grahn

[11] Patent Number: 5,836,331

[45] Date of Patent: Nov. 17, 1998

[54] VENTILATING DEVICE

[76] Inventor: Bengt Grahn, Abmorvägen 47, S 930 86 Moskosel, Sweden

[21] Appl. No.: 129,043

[22] PCT Filed: Apr. 2, 1992

[86] PCT No.: PCT/SE92/00208

§ 371 Date: Dec. 30, 1994

§ 102(e) Date: Dec. 30, 1994

[87] PCT Pub. No.: WO92/18728

PCT Pub. Date: Oct. 29, 1992

[30] Foreign Application Priority Data

Apr. 9, 1991 [SE] Sweden ..... 9101048

[51] Int. Cl.[6] ..... E04H 15/16

[52] U.S. Cl. ..... 135/94; 135/92; 135/99; 135/100

[58] Field of Search ..... 135/94 OR, 99, 135/100, 92, 91, 93

[56] References Cited

U.S. PATENT DOCUMENTS

| | | | |
|---|---|---|---|
| 39,416 | 8/1863 | Moakley | 135/94 |
| 396,846 | 1/1889 | Ancel | 135/92 |
| 522,483 | 7/1894 | Noonan | 135/92 |
| 1,428,343 | 9/1922 | Runcie | 135/100 |
| 1,576,942 | 3/1926 | Beebe | 135/100 |
| 2,527,729 | 10/1950 | Hoff | 135/94 |
| 3,181,543 | 5/1965 | Petrie | 135/100 |
| 3,406,698 | 10/1968 | Hutchison | 135/100 |
| 3,875,952 | 4/1975 | Black | 135/91 |
| 4,744,381 | 5/1988 | Pritchett | 135/93 |
| 4,838,293 | 6/1989 | Novak | 135/100 |

*Primary Examiner*—Carl D. Friedman
*Assistant Examiner*—Winnie S. Yip
*Attorney, Agent, or Firm*—Cohn, Powell & Hind

[57] ABSTRACT

A ventilation device for tents with at least one roof top (8) and a place for an open fire under this roof top, the tent cloth (4) having an upper boundary (12) at a distance below the apex of this roof top, so that an opening (9) for discharging flue gases coming from a fire is formed at the roof top, comprises a net (10) substantially impervious to insects, which is arranged in said flue gas opening (9) so as to prevent insects from getting into the tent through this opening. The insects net is movably arranged with respect to the frame work of the tent and the device further comprises an arrangement (14, 15, 18) for regulating the degree of the coverage of the flue gas opening by the insects net between a first position substantially entirely covering it and at least a position in which the flue gas opening is at least partially set free.

13 Claims, 4 Drawing Sheets

11
13
5
2
10
24
24
12
14
16
19
18

VENTILATING DEVICE

FIELD OF THE INVENTION AND PRIOR ART

The present invention relates to a ventilating device for tents with at least one roof top and a place for an open fire under this roof top, the tent cloth having an upper boundary at a distance below the apex of this roof top, so that an opening for discharging flue gases coming from a fire is formed at the roof top. That the fire is located under the roof top is to be interpreted in a wide sense, and it may well be arranged substantially displaced in the horizontal direction with respect to the roof top.

Tents provided with this type of ventilating devices could be called fire tents, and an example of such a tent is the hut of the Lapps and the tepees of the Indians, and this field of use will in the following be discussed by way of illustration but not as a limitation.

Ventilating devices of the type described above are necessary in huts so as to make it possible for the flue gases coming from the fire and rising to leave the hut. However, a disadvantage of the devices already known consists in that insects unpleasant for the users of the hut, especially midges, may get into the hut through the flue gas opening when the fire dies. This can not either be avoided by closing a flue gas fly possibly being a part of the ventilating device, since it is necessary that the smoke may pass out through the flue gas opening also when the fire is dying.

Furthermore, in such a ventilating device it is desirable to be able to regulate the flue gas fly in a simple way should there be one.

BRIEF DESCRIPTION OF THE INVENTION

The object of the present invention is to solve the problems mentioned above.

The first of these objects is obtained in accordance with the invention by providing a ventilating device of the type according to the introduction with a net substantially impervious to insects, that the insects net is arranged in said flue gas opening so as to prevent insects from getting into the tent through this opening, that the insects net is movably arranged with respect the framework of the tent and the device further comprises an arrangement for regulating the degree of the coverage of the flue gas opening by the insects net between a first position substantially completely covering it and at least a position, in which the flue gas opening is at least partially exposed for a reduced flow resistance to flue gases.

Thanks to this feature of a ventilating device according to the invention it will be possible to prevent insects from getting into the tent through the flue gas opening of prior tents provided with the device. When a fire is burning with full power in the tent it is not possible that an insects net completely covers the flue gas opening, but the main part thereof must be exposed or set free, since otherwise the flow resistance for the flue gases will be so high that the flue gases are spread inside the tent. However, to put the insects net aside in that manner has no prejudicial influence on the ability of the ventilating device to keep the insects out, since the flue gases manage to prevent the insects from getting in through the flue gas opening in this fire condition. When the strength of the fire after that is reduced the degree of the covering of the flue gas opening by the insects net may thanks to the utilization of the regulating arrangement of the ventilating device according to the invention be increased, and this flue gas creation is that low when the fire is dying that the insects net may be regulated to completely cover the flue gas opening and in spite thereof enable an appropriate discharging of flue gases through the opening. This means that persons present in the fire tent may go to bed when the fire is dying and are spared from discomforts procured by insects getting into the tent through the flue gas opening during their nights sleep.

Thanks to the combination of the features according to the invention; insects net and regulating arrangement for this insects net, the problem being the basis of the invention may accordingly be solved in a satisfying way.

In a preferred embodiment of the invention, which is applicable to tents, the roof top of which is substantially cone-shaped, such as a hut, the insects net is flexible and has in the first position substantially the shape of an unbroken cone, the apex of which is arranged at the apex of the roof top, and the regulating arrangement comprises at least a first traction transmitting element connected to the lower edge of the cone and led upwardly to the region of the top of the cone and then downwardly, and that the traction element is arranged to on pulling thereof in the part led downwardly from the top of the cone downwardly pull the lower edge of the cone upwardly so as to set at least a part of the flue gas opening free from the insects net. This embodiment of the ventilating device enables a very simple regulation of the degree of coverage of the flue gas opening by the insects net, wherein said traction element may be led downwardly to such a level, that regulation easily may take place from the ground, and this leading downwardly may according to the desires be made inside or outside the tent so as to make regulating possible in the place being judged to be most suitable in the case in question. Furthermore, thanks to the construction according to the invention of the insects net as an unbroken cone it is very easy to achieve a total coverage of the entire flue gas opening by the insects net in a completely reliable way, since this has no splitting, which could be problematically to keep tight in particular because the influence of the wind.

Another object of the invention is obtained by providing the ventilating device according to the invention with a flue gas fly, since it is important that the flue gas opening in every situation may be obstructed so much as possible by material retaining heat in the interior of the tent, and measures have been taken for regulating such a flue gas fly.

Further advantages and advantageous characteristics of the invention will appear from the following description and the other dependent claims.

BRIEF DESCRIPTION OF THE DRAWINGS

With reference to the appended drawings below follows a description of preferred embodiments of the invention cited as examples.

In the drawings.

DETAILED DESCRIPTION OF PREFERRED EMBODIMENTS OF THE INVENTION

Figure 1:
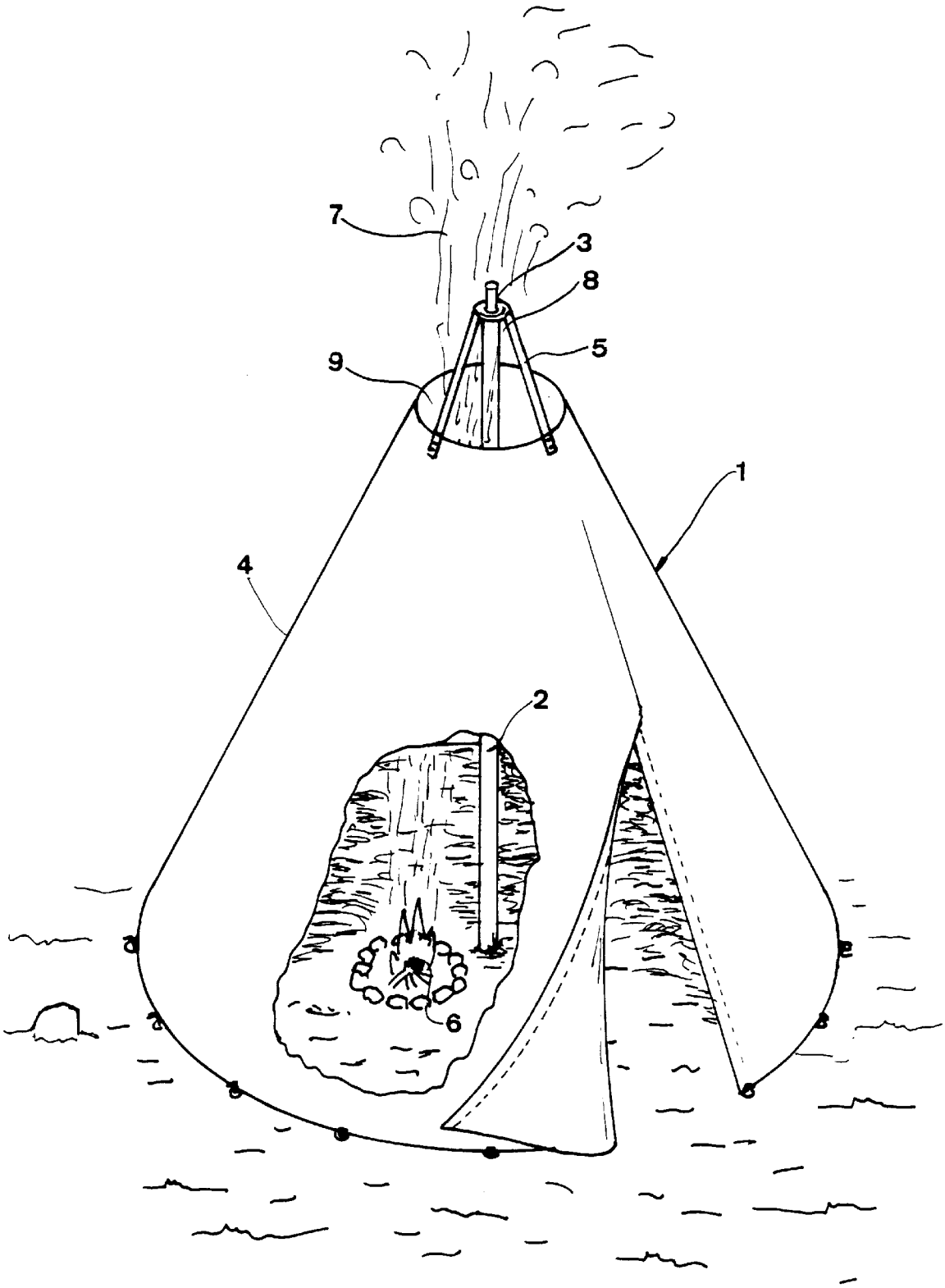
FIG. 1 is a schematic partially sectioned view of a type of hut with an open fire, which is intended to illustrate the problem according to the invention.
Figure 2:
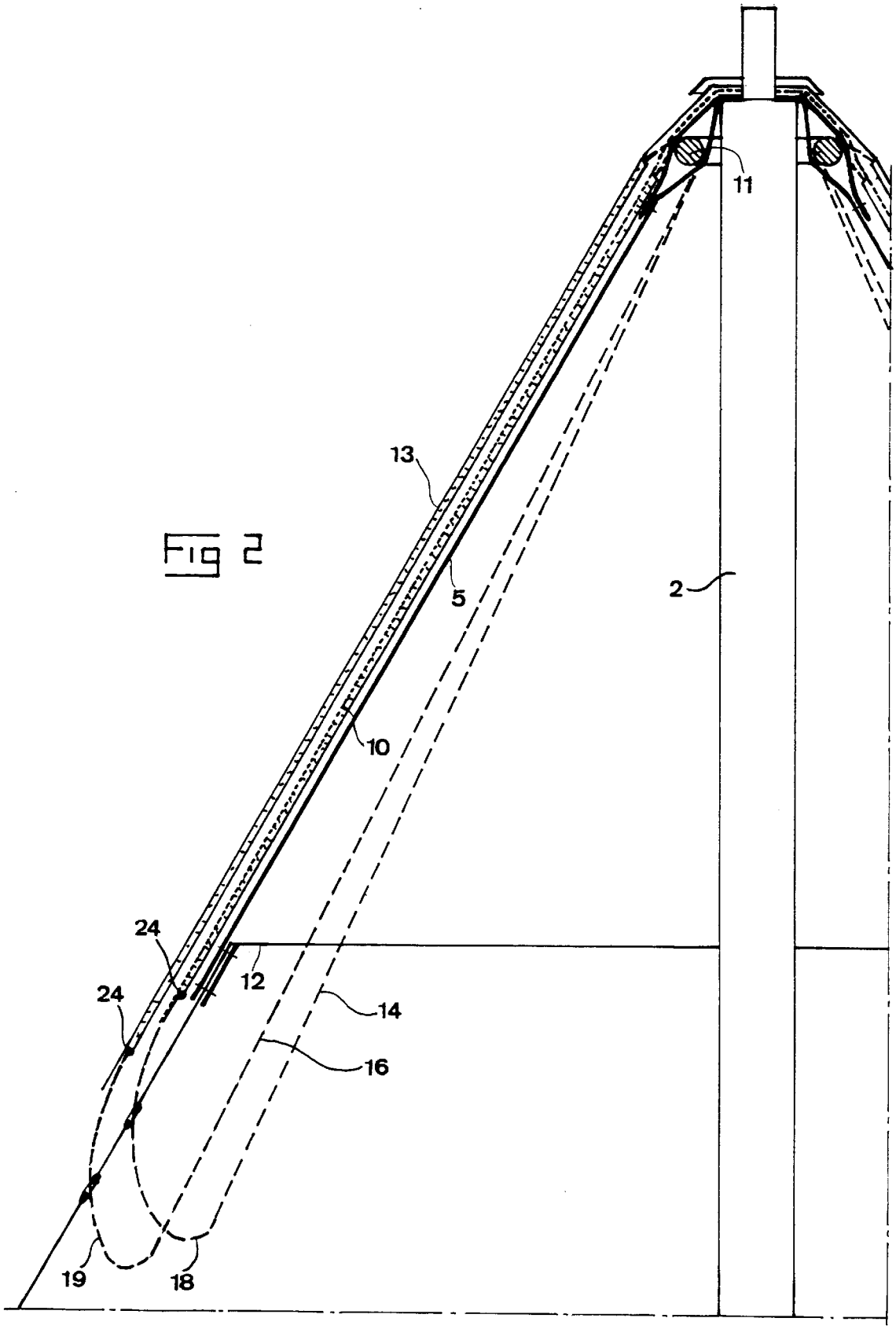
FIG. 2 is an enlarged sectioned view of a first preferred embodiment of the ventilating device according to the invention applied to the top of a hut with a central pole and in a first position of the flue gas fly as well as the insects net.

The problem according to the invention is schematically illustrated in FIG. 1 by the reproduction of a fire tent in the form of hut 1 of a recent construction with a centre pole 2, which bears on the ground and by its upper end carries the tent cloth 4 through carrying belts 5 secured to the region of the upper boundary of the tent cloth (see more particularly FIG. 2). The tent cloth 4 is through conventional tent-pegs at the bottom secured to the ground and it is only carried by the centre pole 2, but it would of course also be possible that further lateral support rods were peripherally arranged so as to support the hut in the lower region thereof.

The fire place with a fire 6 is located on the floor in the hut, and the flue gases 7 produced by this fire may escape out of the hut through the flue gas opening 9 formed at the top 8 of the hut thanks to the stop of the tent cloth further down.

A problem with this type of tents is as described in the introduction that insects will manage to get into the hut through the opening 9 when the fire is dying or there is no fire at all. When there is no fire at all this could sometimes be avoided by the existence of a flue gas fly, which in absence of a fire may be brought to completely cover the flue gas opening 9, but should a dying fire exist, it will be necessary to at least partially keep the flue gas opening open, and this may also be desirable in absence of fire so as to obtain a certain change of air inside the hut.

A first embodiment of the ventilating device according to the invention is shown in FIG. 2, which is applied to a hut 1 shown in FIG. 1. The device comprises a flexible insects net 10 with substantially the shape of an unbroken or continuous cone in a first position shown in FIG. 1, in which it substantially covers the entire flue gas opening 9. The insects net 10 is at its upper end, its cone apex, arranged on the upper apex 3 of the centre pole 2 and hangs down therefrom while resting on the carrying belts 5 of the tent cloth, which prevent the insects net 10 from falling into the flue gas opening 9 as a consequence of the gravitation. The carrying belts 5 are secured to a top ring 11 of the centre pole. The insects net 10 is arranged to extend downwardly over the upper edge 12 of the tent cloth in the first position shown in FIG. 2, so that substantially the entire flue gas opening is covered by the insects net. A flue gas fly 13 of similar fabric as the tent cloth, also with substantially the shape of an unbroken cone, is arranged outside the insects net. The flue gas fly 13 extends from the top end 3 of the centre pole and bears on the outside on the insects net 10 and thus indirectly on the carrying belts 5 so as to be terminated a bit below the upper edge 12 of the tent cloth. The flue gas fly 13 completely closes the flue gas opening in this position and no firing is possible. The insects net and the flue gas fly may according to need be made of material with a good resistance to heat.

So as to avoid that the flue gas fly 13, when it from the open position thereof is brought downwardly to the closed position according to FIG. 2, press the tent cloth 4 inwardly towards the centre of the tent, so that the openings, through which midges may get in, are created between the tent cloth and the flue gas fly, flexible pins not shown, for instance of glass fibre, are arranged immediately under the upper edge 12 of the tent cloth and to be received in pockets sewn in the tent cloth, each extend between adjacent connections of carrying belts 5 to the tent cloth and together extend or stretch out the tent cloth in the region of the upper edge thereof so that said openings are never created.

First traction transmitting elements in the form of lines 14 are connected to the lower end of the insects net around the periphery thereof and after that led through guide members 15 arranged on the insects net, here in the form of channels sewn, towards the top of the insects net and through the top ring 11 there diverted downwardly and hanging along the inner wall of the tent cloth to a place easily accessible from the floor of the hut. By pulling one or several of the lines 14 downwardly along the tent cloth the insects net 10 may with its lower edge be hoisted upwardly along the carrying belts 5 while setting a desired part of the flue gas opening free. Thanks to the arrangement of the guide members 15 the lower connection of the line with the insects net will on such pulling of any of the lines 14 always constitute the lower edge of the cone, so that the lower edge of the insects net is hoisted a distance being equal to the distance over which a line 14 has been pulled downwardly along the pole 2. However, it may in the praxis be so that the lower edge mentioned here and in the following is not located lowest, since a certain folding over and a hanging of material portions therebelow may be present.

Second traction transmitting elements 16, here in the form of lines, are in an analogous way connected to the lower portion of the flue gas fly 13 and led through guide members 17 arranged on the flue gas fly 13 to the top end 3 of the centre pole and there diverted downwardly through the top ring along the inner wall of the tent cloth. Pulling these lines 16 procure hoisting of the flue gas fly 13 and setting the flue gas opening free in the same way as described for the insects net 10.

Third traction transmitting elements 18 are secured to the lower end of the insects net and fourth traction transmitting elements 19 are secured to the lower end of the flue gas fly and led downwardly and through the inner wall of the tent cloth and by pulling the respective lines 18 and 19 in hoisted positions of the insects net and the flue gas fly, respectively, the latters may be brought downwardly towards the first position shown in FIG. 2. The first and third traction elements and the second and fourth traction elements, respectively, are combined to a common line loop with a stop element 24 with a larger cross section than said guide member in the embodiment shown in FIG. 2. However, it would also be possible to arrange separate lines for the respective traction element. The traction element loops would in the practice be led further downwardly along the inner tent wall than schematically shown in FIG. 2, since it is desirable that an easy operation of the insects net and the flue gas fly may take place from the ground without that a person carrying out the operation has to be located in direct connection to the flue gas opening.

The degree of coverage of the flue gas opening 9 by the insects net and the flue gas fly may thanks to the regulating arrangement formed by the lines 14, 16, 18 and 19 be infinitely varied in a very comfortable way from the interior of the hut. However, it would also be possible to, when desired, lead the different traction elements downwardly on the outside of the hut for regulating therefrom.

Figure 3:
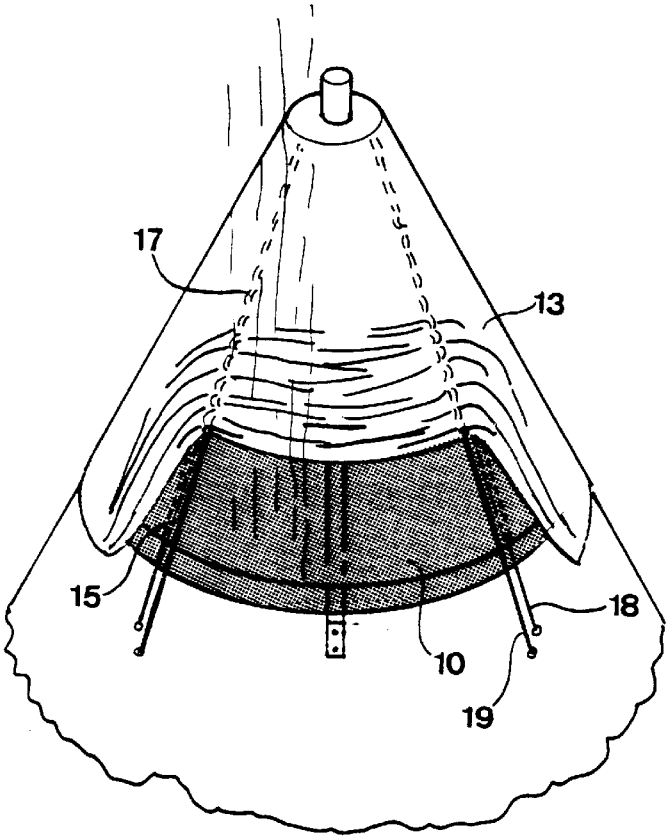
FIG. 3 is a view illustrating the ventilating device according to FIG. 2 with a flue gas fly partially hoisted.

A position of the ventilating device according to the invention, in which a dying fire is present in the hut, is shown in FIG. 3, which requires that the flue gas fly is partially hoisted, but the insects net 10 is in the position covering substantially the entire flue gas opening. Thus, the persons being in the hut may in this situation go to bed before the fire has completely died and in spite thereof be spared from getting their nights rest disturbed by insects getting in through the flue gas opening.

Figure 4:
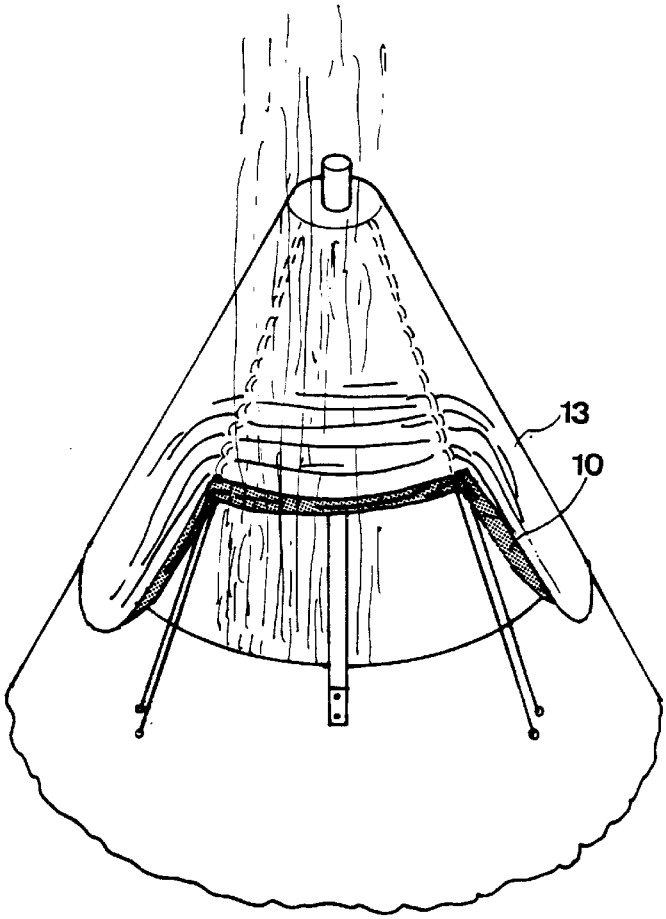
FIG. 4 is a view corresponding to FIG. 3 with the flue gas fly as well as the insects net partially hoisted, and FIG. 5 a simplified view of a fire tent provided with a second preferred embodiment of a ventilating device according to the invention.

FIG. 4 shows a ventilating device in a position, in which firing takes place in the hut and accordingly substantially the entire flue gas opening has to be set free by the flue gas fly as well as the insects net. These have therefore been hoisted to the top 8 of the hut through pulling the lines 14 and 16.

Figure 5:
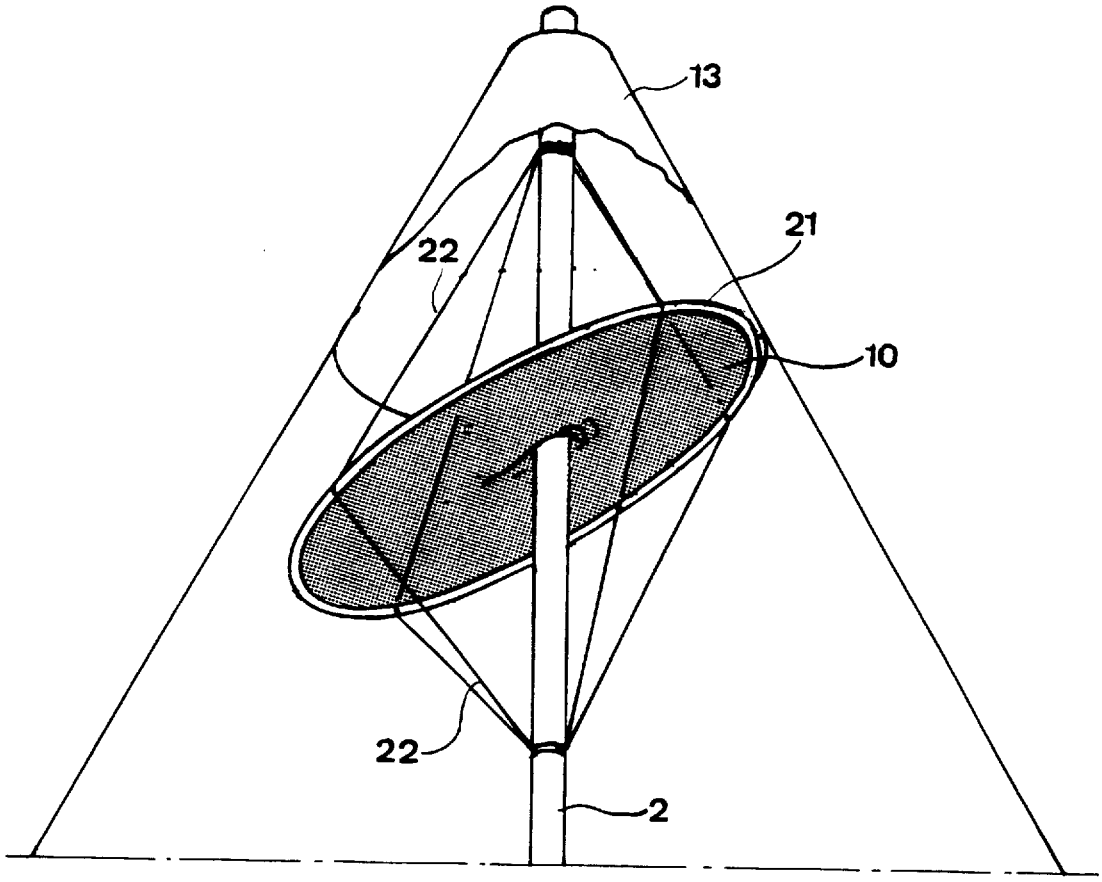

Finally, an alternative embodiment of the insects net 10 is shown in FIG. 5, in which the insects net is braced on a substantially circular frame 21 with substantially the same dimensions as the vertical projection of the flue gas opening 9 of the hut 1. The frame 21 is penetrated at a centre thereof by the centre pole 2 and pivotally held through lines 22 thereat about an axis being substantially perpendicular thereto. The lines 22 are led downwardly so as to by pulling thereof procure pivoting of the frame about said perpendicular axis and by that bring the insects net between the first position substantially closing the flue gas opening 9 and second positions setting the flue gas opening partially or entirely free. An easy regulation of the insects net from the ground may also be carried out in this embodiment thereof by pulling the lines 22. The flue gas fly may be of the same type as described in FIG. 2–4.

The invention is of course not restricted to the preferred embodiments described above, but several possibilities to modifications thereof would be apparent to a man skilled in the art without departing from the basic idea of the invention.

The device according to the invention could for example be applied to tents with more than one top and also to tents with an apex not being cone-shaped.

The traction transmitting elements could, at least in the part. led downwardly along the centre pole, be rigid and for example be constituted by pins. They could also be of a greater number or only one single of each kind. It would also be conceivable to design the part of the traction transmitting elements running in the guide members in the insects net and the flue gas fly, respectively, as a bendable pin and so that pulling the lower end of this pin (arranged at the lower edge of said net and fly, respectively) produces this bending of the pin in an arc outwardly from the centre of the hut while pulling the lower end of the pin upwardly towards the top. An upper lateral opening for flue gases and at the same time a covering of this opening from above against rain and snow is obtained in this way.

The guide members for the different traction elements could be designed in an arbitrary way, for instance as channels instead of straps.

The insects net, the flue gas fly and the regulating arrangements thereof may of course be completely removable from the rest of the tent when desired.

However, it is suitable to point out that the invention is just as well applicable to a hut having no centre pole and instead a stand of rods of a suitable material such as wood or aluminium, diverging from the top of the hut. The design of the other parts of the tent is thereby of course modified within the scope of the invention in the way required for obtaining the function according to the invention.

The framework of the tent in the claims relates to the parts of the tent intended to be stationarily arranged, such as for example the tent cloth, besides the possible movable parts thereof. The roof top relates not necessarily to the absolute top, but the region therearound is also comprised.

I claim:

1. A tent having a tent cloth (4) and a framework forming a roof top (8) having an apex, and a place for an open fire (6) under said roof top, the tent cloth (4) having an upper boundary (12) at a distance below the apex of said roof top, so that an opening (9) for discharging flue gases (7) coming from a fire is formed at the roof top, said roof top of the tent being substantially cone-shaped, the tent comprising a flue gas fly (13) of flexible cloth arranged in the flue gas opening, said flue gas fly arranged, in a first position substantially closing the flue gas opening, to have a shape of an unbroken cone having a lower edge and a top having an apex, the apex of the flue gas fly being arranged at the apex of the roof top and supported by said framework, characterized in that the tent having means (16, 17, 19) for regulating the closing degree of the flue fly (13), said means comprising at least one traction transmitting element (16) connected to the lower edge of the flue gas fly cone and having a part extending upwardly to a region of the top of said cone and then extending downwardly, said traction elements being arranged so that pulling downwardly on the part extending downwardly from the top of the cone pulls the lower edge of the cone upwardly so as to set at least a part of the flue gas opening (9) free from the flue gas fly (13).

2. The tent according to claim 1 characterized in that said tent comprises a net (10) substantially impervious to insects and carried on the framework, that said net is arranged in said flue gas opening (9) inside of the flue gas fly so as to prevent insects from getting into the tent (1) through said opening, said net is movably arranged with respect to the framework of the tent and the tent further comprises means (14, 15, 18) for regulating the degree of the coverage of the flue gas opening (9) by said net between a first position substantially completely covering said flue gas opening and at least a position, in which the flue gas opening is at least partially exposed for a reduced flow resistance to flue gases.

3. The tent according to claim 2, in which the roof top of the tent is substantially cone-shaped, characterized in that said net (10) is flexible and adapted to, in the first position, substantially have the shape of an unbroken cone having a lower edge and a top having an apex, the apex being arranged at the apex of the roof top, that the regulating means of the net comprises at least another traction transmitting element (14) connected to the lower edge of the cone and having a part extending upwardly to the region of the top of the cone and then a part extending downwardly, and that the traction element is arranged so that pulling downwardly on the part extending downwardly from the top of the cone pulls the lower edge of the cone upwardly so as to set at least a part of the flue gas opening (9) free from said net (10).

4. The tent according to claim 3, characterized in that said flue gas fly (13) is arranged outside of said net (10).

5. The tent according to claim 3, characterized in that the tent further includes elongated elements (5) being connected to the upper boundry (12) of the tent cloth and extending to the apex of the roof top, that said net is adapted to rest upon said elongated elements and that said elongated elements are adapted to ensure that said net moves substantially the envelope surface of said cone on pulling said other traction element (14).

6. The tent according to claim 3, characterized in that the framework of the tent comprises a stand formed by rigid elongated support elements extending outwardly from the top of the tent and diverging downwardly and arranged to carry said tent cloth, that said net (10) is arranged to rest upon a plurality elongated elements, and that said elongated elements are arranged to ensure that said net moves substantially along the envelope surface of said cone on pulling said other traction element (14).

7. The text according a claim 1, characterized in that elongated elements (5) are connected to the upper boundary (12) of the tent cloth and extent to the apex of the roof top, that the flue gas fly (13) is adapted to rest upon said elongated elements, and that said elongated elements are arranged to ensure that the flue gas fly moves substantially along the envelope surface of said cone on pulling said one traction element (16).

8. The tent according to claim 3, characterized in that net (10) is arranged to in said first position extend downwardly over the upper boundary (12) of the tent cloth, and that at least a third traction elements (18) is connected to the lower end of said net, extended downwardly and arranged so that on pulling downwardly thereof brings said net (10) from a hoisted position back to the first position.

9. The tent according to claim 1, characterized in that the flue gas fly (13) is adapted in said first position to extend downwardly over the upper boundary (12) of the tent cloth, and that at least an additional traction element (19) is connected to the lower edge of the flue gas fly, extended downwardly and arranged so that on pulling thereof brings the flue gas fly from a hoisted position back to the first position.

10. The tent according to claim 3, characterized in that said other traction transmitting element (14) extends from the roof top downwardly into the tent to a position enabling regulation of said net (10) from within said tent.

11. The tent according to claim 1, characterized in that said one traction transmitting element (16) extends from the roof top downwardly into the tent to a position enabling regulation of the flue gas fly (13) from within said tent.

12. The tent according to claims 1, 2, 7, 9, or 11, which further comprises a pole (2) extending from the ground up to said roof top, characterized in that said net (10) is braced on a substantially circular frame (21), a dimension of the circular frame substantially larger than the vertical projection of the flue gas opening (9), is arranged to be penetrated by the pole at a center of said circular frame and be pivotally held thereat about an axis of said pole substantially perpendicular to said circular frame, and a force transmitting element (22) is connected to the circular frame so as to pivot the circular frame (21) about said perpendicular axis thereby bring said net (10) between the first position and second position setting the opening free to a varying extent.

13. The tent according to claim 1 or 3, characterized in that one of said traction transmitting elements (14, 16) extends in a guide (15) extending from the lower edge of the cone towards the apex thereof and arranged so that pulling the traction elements ensures that the location of a lower connection of the traction element to the cone always constitutes the lower edge of the cone on hoisting thereof.

* * * * *